US010441982B2

(12) United States Patent
Iguchi et al.

(10) Patent No.: US 10,441,982 B2
(45) Date of Patent: Oct. 15, 2019

(54) PLUG FOR ROLLING OF SEAMLESS STEEL PIPE, METHOD FOR MANUFACTURING THE SAME AND METHOD FOR MANUFACTURING SEAMLESS STEEL PIPE USING THE SAME

(71) Applicant: JFE STEEL CORPORATION, Tokyo (JP)

(72) Inventors: Takaaki Iguchi, Tokyo (JP); Tatsuro Katsumura, Tokyo (JP); Hideto Kimura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 151 days.

(21) Appl. No.: 14/427,414

(22) PCT Filed: Sep. 9, 2013

(86) PCT No.: PCT/JP2013/005324

§ 371 (c)(1),
(2) Date: Mar. 11, 2015

(87) PCT Pub. No.: WO2014/041787

PCT Pub. Date: Mar. 20, 2014

(65) Prior Publication Data

US 2015/0217349 A1 Aug. 6, 2015

(30) Foreign Application Priority Data

Sep. 11, 2012 (JP) ..... 2012-199027

(51) Int. Cl.
*C23C 8/02* (2006.01)
*C23C 8/12* (2006.01)
(Continued)

(52) U.S. Cl.
CPC ..... *B21B 28/00* (2013.01); *B21B 25/00* (2013.01); *C23C 8/02* (2013.01); *C23C 8/12* (2013.01);
(Continued)

(58) Field of Classification Search
CPC ..... B21B 25/00; B21B 19/04; B21B 28/00; C23C 4/02; C23C 4/04; C23C 4/10;
(Continued)

(56) References Cited

U.S. PATENT DOCUMENTS 2,392,821 A * 1/1946 Kreag ..... B21B 25/00 420/442
3,237,441 A 3/1966 Fritz
(Continued)

FOREIGN PATENT DOCUMENTS

CN 101 596 551 A 12/2009
CN 102284777 A 12/2011
(Continued)

OTHER PUBLICATIONS

Machine Translation of JP2004-344923, Hidaka, Yasuyoshi, Translated Sep. 14, 2018, 4 Pages.*
(Continued)

*Primary Examiner* — Gregory D Swiatocha
(74) *Attorney, Agent, or Firm* — Oliff PLC

(57) ABSTRACT

A plug for rolling of a seamless steel pipe, the plug having an oxide layer composed of a cobalt-base oxide on a surface of a coating layer formed by coating a surface of a base metal with cobalt or a cobalt-base alloy, a method for manufacturing the plug and a method for manufacturing a seamless steel pipe using the plug.

14 Claims, 4 Drawing Sheets

1: PLUG BODY
2: COBALT-BASE PLATING FILM
3: OXIDE LAYER MADE OF COBALT-BASE OXIDE

(51) Int. Cl.

| | |
|---|---|
| ***C25D 5/50*** | (2006.01) |
| ***C25D 7/00*** | (2006.01) |
| ***B21B 19/04*** | (2006.01) |
| ***B21B 25/00*** | (2006.01) |
| ***B21B 28/00*** | (2006.01) |

(52) U.S. Cl.
CPC ..... *C25D 5/50* (2013.01); *C25D 7/00* (2013.01); *B21B 19/04* (2013.01)

(58) Field of Classification Search
CPC .... C23C 4/11; C23C 8/02; C23C 8/12; C25D 5/50; C25D 7/00
See application file for complete search history.

(56) References Cited

U.S. PATENT DOCUMENTS

| | | | | | |
|---|---|---|---|---|---|
| 3,615,884 | A | * | 10/1971 | Collins | C23C 30/005 148/286 |
| 3,962,897 | A | * | 6/1976 | Way | B21B 25/00 420/436 |
| 4,034,588 | A | * | 7/1977 | Way | B21B 25/00 420/436 |
| 5,778,714 | A | * | 7/1998 | Katsumura | B21B 25/00 72/209 |
| 2009/0297717 | A1 | | 12/2009 | Hori et al. | |

FOREIGN PATENT DOCUMENTS

| | | | | |
|---|---|---|---|---|
| EP | 0 743 106 | A1 | | 11/1996 |
| EP | 2 281 642 | A1 | | 2/2011 |
| JP | H60-137511 | A | | 7/1985 |
| JP | H62-050038 | A | | 3/1987 |
| JP | H63-203205 | A | | 8/1988 |
| JP | H02-112805 | A | | 4/1990 |
| JP | H03204106 | A | | 9/1991 |
| JP | H06-315704 | A | | 11/1994 |
| JP | H08-193241 | A | | 7/1996 |
| JP | 2001-038408 | A | | 2/2001 |
| JP | 2004344923 | A | * | 12/2004 |
| JP | 2007-160338 | A | | 6/2007 |
| JP | 200945632 | A | * | 3/2009 |
| WO | 2006/106637 | A1 | | 10/2006 |

OTHER PUBLICATIONS

Machine Translation of JP2004-045632, Nakaike, Hirotsugu, Translated Sep. 14, 2018, 8 Pages.*
Nov. 2, 2016 Office Action issued in Chinese Patent Application No. 201380046791.5.
Jul. 27, 2015 Search Report issued in European Application No. 13 83 6269.4.
Oct. 15, 2013 International Search Report issued in PCT/JP2013/005324.
Apr. 21, 2016 Office Action issued in Chinese Application No. 201380046791.5.
Jul. 3, 2017 Office Action issued in Chinese Patent Application No. 201380046791.5.
Feb. 5, 2018 Office Action issued in European Patent Application No. 13 836 269.4.

* cited by examiner

1: PLUG BODY
2: COBALT-BASE PLATING FILM
3: OXIDE LAYER MADE OF COBALT-BASE OXIDE

PLUG FOR ROLLING OF SEAMLESS STEEL PIPE, METHOD FOR MANUFACTURING THE SAME AND METHOD FOR MANUFACTURING SEAMLESS STEEL PIPE USING THE SAME

TECHNICAL FIELD

The present application relates to a plug for rolling of a seamless steel pipe, which is a hot rolling tool, a method for manufacturing the plug and a method for manufacturing a seamless steel pipe using the plug.

BACKGROUND

A Mannesmann mill process has been widely used as a method for manufacturing seamless steel pipes using hot processing in the past. This is a method for manufacturing a seamless steel pipe having specified dimensions by firstly performing piercing on a round shape steel (hereinafter, called a billet) which has been heated up to a specified temperature using a piercing mill in order to make a hollow piece (hereinafter, called a hollow), by decreasing the thickness of the hollow using a main rolling mill such as an elongator, a plug mill or a mandrel mill, by further reheating the hollow as needed and then by mainly reducing the outer diameter of the hollow using a reducing mill or a sizing mill.

As for the piercing mill mentioned above, there are various kinds of piercing mills, and common examples of piercing mills include a so-called Mannesmann piercer consisting of two barrel type rolls, a plug and two guide shoes, a so-called 3-roll piercer consisting of three barrel type rolls and a plug, and a so-called press rolling piercer consisting of two grooved rolls and a plug.

In the piercing process mentioned above, since a plug is constantly exposed to a high temperature and a high load due to ceaseless contact with a heated billet or a hollow, the plug tends to undergo wear or deformation due to an elevated temperature. Therefore, a scale film having a thickness of several tens of μm to several hundreds of μm may be formed on the surface of the plug by performing scale handling on the plug at a high temperature of 900° C. to 1000° C. in order to prevent wear damage. For example, Patent Literature 1 discloses a technique in which iron oxide scale mainly containing magnetite is formed on a surface of a plug having a base metal composed of an iron-base alloy by performing a heat treatment on the plug. Since such oxidized scale prevents metallic contact between the metal of a rolled material and the metal constituting the plug by being present as a nonmetallic coating between the metals when hot rolling is performed, seizure and deposition are prevented and the amount of wear is decreased, which results in there being effects of protecting the plug and increasing the life of the plug. In the case where a rolled material is a high alloy containing a large amount of Cr, since there is a decrease in tool life due to frequent metallic contact between the material and a tool such as a plug because only a very small amount of surface scale is generated due to the nature of the material when the material is heated, such a technique in which oxidized scale is artificially formed on the surface of a tool is particularly effective.

However, in the case where a rolled material is high-alloy steel such as steel containing 12 mass % or more of Cr, since the number of rolled materials which can be rolled with one plug is only about 10 at most even using the technique described above, a further increase in tool life is required.

The reason why plug life is insufficient in the case where a rolled material is high-alloy steel containing 12 mass % or more of Cr is that, since the high-temperature strength of a plug composed of an iron-base alloy is comparatively low because the strength of the rolled material is high during hot processing, deformation such as the crush of the plug tip or the gouge of the surface of the plug occurs due to a contact load even though the surface of the plug is protected with oxidized scale, which results in the surface scale layer being broken and defects such as seizure occurring.

Therefore, in order to increase the life of a plug for the piercing of a seamless steel pipe in the case where high-alloy steel described above is rolled, methods such as one in which the whole or tip of a plug is composed of ceramic (Patent Literature 2) or a molybdenum alloy having excellent high-temperature strength (Patent Literature 3), one in which a plug tip is coated with a cobalt-base alloy having a high high-temperature strength by performing powder overlaying welding (Patent Literature 4) and one in which a plug is composed of or coated with a Nb alloy (Patent Literature 5) have been proposed. Moreover, Patent Literature 6 proposes a tool in which a metal-carbide compound film having a matrix metal composed of a cobalt-base alloy or a nickel-base alloy with niobium carbide particles being dispersed in the matrix is formed on the surface of the tool and in which a ferrous oxide film is formed on the outermost surface of the tool.

CITATION LIST

Patent Literature

[PTL 1] Japanese Unexamined Patent Application Publication No. 8-193241

[PTL 2] Japanese Unexamined Patent Application Publication No. 60-137511

[PTL 3] Japanese Unexamined Patent Application Publication No. 63-203205

[PTL 4] Japanese Unexamined Patent Application Publication No. 62-050038

[PTL 5] Japanese Unexamined Patent Application Publication No. 2001-038408

[PTL 6] Japanese Unexamined Patent Application Publication No. 2007-160338

SUMMARY

Technical Problem

There are problems described below with the conventional techniques described above.

In the case of the method according to Patent Literature 2 where only a plug tip is composed of a ceramics in order to strengthen the plug tip, although the method is effective for preventing seizure on the plug tip, since it is difficult to achieve sufficient joint strength between the ceramics portion and the metallic portion, and since the ceramics portion is vulnerable to impact, there is a high risk of the plug fracturing when rolling is performed, which results in the method being impractical. In addition, in the case of the method according to Patent Literature 3 where a plug tip is composed of a molybdenum alloy, the method is disadvantageous, for example, in that molybdenum is very expensive and in that a molybdenum alloy portion is vulnerable to impact load and thermal fatigue.

Moreover, in the case of the methods according to Patent Literatures 4 to 6 where the surface of a plug is coated with a cobalt-base heat-resistant alloy or a nickel alloy by performing, for example, thermal spraying, although the high-temperature strength of the alloy portion is high, since there is a significant increase in friction heat due to direct metallic contact between the alloy portion and a rolled material, there is a problem in that even the strength of the heat-resistant alloy of the plug becomes insufficient due to a further increase in temperature, which results in deformation due to an elevated temperature occurring.

The present disclosure provides, in view of the problems described above, a technique for significantly increasing the life of a plug which is used under severe conditions such as rolling of a seamless steel pipe made of high-alloy steel.

Solution to Problem

Disclosed embodiments have been completed in order to solve the problems described above and are provided as follows.

(1) A plug for rolling of a seamless steel pipe, the plug having an oxide layer composed of a cobalt-base oxide on a surface of a coating layer formed by coating a surface of a base metal with cobalt or a cobalt-base alloy.

(2) The plug for rolling of a seamless steel pipe according to item (1), in which the cobalt-base alloy contains 30 mass % or less of nickel.

(3) The plug for rolling of a seamless steel pipe according to item (1) or (2), in which the oxide layer is formed by performing a heat treatment of holding at a high temperature.

(4) The plug for rolling of a seamless steel pipe according to item (1) or (2), in which the oxide layer is formed using the heat applied when rolling of a seamless steel pipe is performed.

(5) The plug for rolling of a seamless steel pipe according to item (1) or (2), in which the oxide layer is formed by performing a heat treatment of holding at a high temperature and using the heat applied when rolling of a seamless steel pipe is performed.

(6) The plug for rolling of a seamless steel pipe according to any one of items (1) to (5), in which an average thickness of the oxide layer is 10 μm or more and 40 μm or less.

(7) The plug for rolling of a seamless steel pipe according to any one of items (1) to (6), in which the base metal is composed of ferrous material.

(8) A method for manufacturing a seamless steel pipe, the method including using the plug for rolling of a seamless steel pipe according to any one of items (1) to (7).

(9) A method for manufacturing a plug for rolling of a seamless steel pipe, the method including coating a surface of a metallic plug with a film composed of cobalt or a cobalt-base alloy having a thickness of 0.1 mm or more and 2 mm or less and then performing a heat treatment in atmospheric air at a temperature of 300° C. or higher and 1000° C. or lower in order to form an oxide layer composed of a cobalt-base oxide having an average thickness of 10 μm or more and 40 or μm less.

(10) The method for manufacturing a plug for rolling of a seamless steel pipe according to item (9), in which the heat treatment is a heat treatment of holding at a high temperature.

(11) The method for manufacturing a plug for rolling of a seamless steel pipe according to item (9) or (10), in which the heat treatment is performed using the heat applied when rolling of a seamless steel pipe is performed.

Advantageous Effects

According to embodiments, since an effect of decreasing the degree of wear damage of a plug which is used for rolling of a seamless steel pipe is realized, effects of making productivity efficient and decreasing cost are realized.

DETAILED DESCRIPTION OF EMBODIMENTS

For purposes of this disclosure, "cobalt-base alloy" refers to an alloy whose content [mass %] of cobalt is the highest among those of its constituent chemical elements.

The present inventors focused on the fact that cobalt is comparatively easily oxidized and coated with a thin and strong oxide layer at a high temperature. Although the oxidation rate of cobalt is significantly small in comparison to that of ferrous materials, since the oxidation rate of cobalt is large in comparison to those of nickel-base super alloys or those of some kinds of cobalt-base super alloys containing, for example, Ni, W and Cr, an oxide layer composed of a cobalt-base oxide (hereinafter, referred to as cobalt-base oxide layer) can easily be formed on its surface in the case where high-temperature treatment is performed in atmospheric air. Such an oxide layer composed of a cobalt-base oxide (cobalt-base oxide layer), like an oxide layer composed of a ferrous oxide (hereinafter, referred to as a ferrous oxide layer) of a ferrous plug, increases a lubricant effect in order to prevent the seizure of a rolled material.

Moreover, since the cobalt-base oxide layer described above also functions as a heat-insulating layer, an excessive increase in temperature in the surface layer of a plug can be prevented, which results in deformation and wear also being prevented. Furthermore, a cobalt-base oxide layer is excellent in terms of strength and life span due to being very tight and having a smooth surface in comparison to an oxide layer composed of ferrous oxide (ferrous oxide layer).

Figure 2:
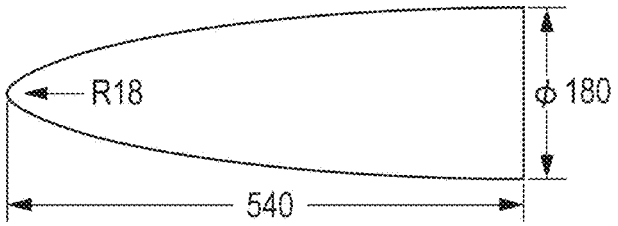
FIG. 2 is a dimensional drawing of a plug described in the EXAMPLES.

However, since a cobalt-base material which is any one of cobalt or a cobalt-base alloy is more expensive than a ferrous material, it is economically impractical to make the whole body of a piercing plug such as, for example, that illustrated in FIG. 2 using a cobalt-base material. Furthermore, since a cobalt-base material is poor in terms of workability, it is difficult to form a cobalt-base material into a plug shape.

Disclosed embodiments solve these problems by coating the surface of a plug composed of a conventional ferrous material with a cobalt-base material having a thickness of 0.1 mm or more and 2 mm or less. Using electroplating, it is possible to easily form this coating film and give the coating film a uniform thickness and good adhesiveness. Although it is necessary that the thickness of the coating layer be 0.1 mm or more in consideration of wear due to the coating layer being repeatedly used about 50 times, since the effect becomes saturated in the case where the thickness is more than 2 mm, it is economically preferable that the thickness be 2 mm or less.

In addition, the base material of the plug according to embodiments, as disclosed in Claim 1 of Japanese Unexamined Patent Application Publication No. 2003-129184, has a chemical composition containing, by mass %, C: 0.05% to 0.5%, Si; 0.1% to 1.5%, Mn: 0.1% to 1.5%, Cr: 0.1% to 1.0%, Mo: 0.5% to 3.0%, W: 0.5% to 3.0%, Nb: 0.1% to 1.5%, further containing Co: 0.1% to 3.0% and Ni: 0.5% to 2.5% those satisfy the relationship $1<(Ni+Co)<4$, and further containing Al: 0.05% or less or one or two selected from among V: 1.5% or less and Ti: 0.3% or less, and the balance being Fe and inevitable impurities. This means that a common material disclosed in a conventional technique is used and is not particularly limited by this disclosure. It is preferable that other ferrous materials such as hot work tool steels including SKD6 and SKD61 in accordance with JIS be used as a base metal.

Alternatively, a nonferrous metal material, for example, a molybdenum alloy, with which it is expected to realize the lubricant effect of the base metal even when some part of a coating film exfoliates, may be used.

Although a cobalt-base material with which the surface of a plug is coated may be pure cobalt metal which contains 99 mass % or more of cobalt and the balance being inevitable impurities, it is more preferable that, by mass ratio, 0.3% or more and 30% or less of Ni be added. By using a cobalt-nickel alloy, since there is an increase in the strength, in particular, high-temperature strength of a plating film, there is an increase in the life of the coating film. In particular, since there is a significant increase in the high-temperature strength of the coating film at a temperature of 300° C. or higher in comparison to a ferrous material, it is also possible to effectively prevent, for example, the deformation of a plug in the case where the thickness of a plated layer is 1 mm or more. However, as described above, since the formation of a cobalt-base oxide layer is suppressed in the case where the nickel content is more than 30% because nickel is a chemical element having oxidation resistance, in the case where a cobalt-nickel alloy is used, it is preferable that the nickel content be, by mass ratio, 0.3% or more and 30% or less, more preferably, by mass ratio, 0.5% or more and 15% or less.

Moreover, since the oxidation rate of a cobalt-base material is very small in atmospheric air at room temperature, it is effective to holding a plated plug in a heating furnace in order to promote the formation of a cobalt-base oxide on the surface of the plug. The generation speed of an oxide layer composed of a cobalt-base oxide is about 0.2 μm/hour in terms of thickness in the case where heating is performed in atmospheric air at 400° C. and about 8 μm/hour in terms of thickness in the case where heating is performed in atmospheric air at 700° C. It is necessary to set a heating time to be longer in the case of a cobalt-nickel alloy containing nickel than in the case of cobalt-base material containing no nickel in order to form an oxide layer having a same thickness. Therefore, it is necessary to change a heating time depending on a material with which the surface of a plug is coated, but it is preferable that a holding temperature be 300° C. or higher from the viewpoint of keeping productivity efficient and that, since there is an increase in the grain diameter of the oxide layer composed of a cobalt-base oxide in the case where the holding temperature is higher than 1000° C., the holding temperature be 1000° C. or lower, more preferably 500° C. or higher and 700° C. or lower.

Disclosed embodiments will now be described on the basis of the following examples.

EXAMPLES The technique of disclosed embodiments was applied to the plug with a specified shape and dimensions illustrated in FIG. 2 which is used in a seamless steel pipe factory.

In examples, low-alloy steel having a chemical composition containing, by mass %, C: 0.2%, Si: 0.5%, Mn: 1.0%, Cr: 0.8%, Mo: 2.0% and Nb: 0.1% was used as a material of the plug according to embodiments.

In conventional techniques, an oxide layer composed of a ferrous oxide is formed on the surface of a plug by performing a heat treatment on the plug.

Figure 3:
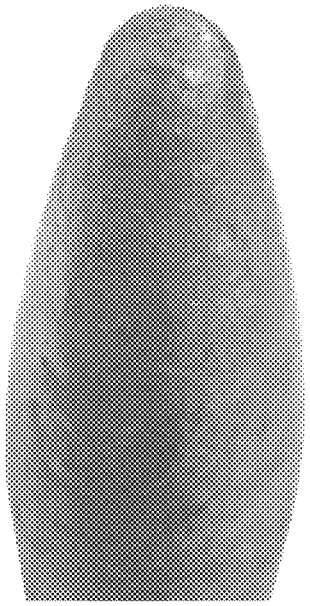
FIG. 3 (RELATED ART)
FIG. 3 is an appearance photograph of a plug according to a conventional technique.

FIG. 3 illustrates the surface photograph of a plug whose surface was coated with a ferrous oxide layer formed by performing a heat treatment suitable for the plug material (heating in atmospheric air at 1050° C. for a holding time of 6 hours). In addition, FIG. 5 schematically illustrates the microstructure of the cross-section of the ferrous oxide layer.

Figure 1:
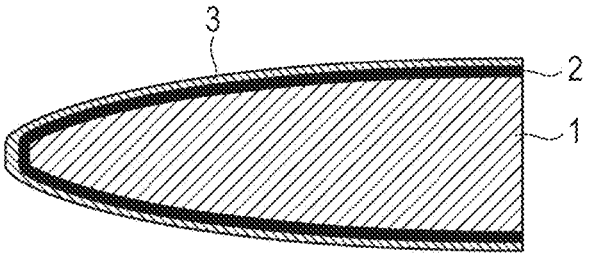
FIG. 1 is a cross-section pattern diagram of a piercing plug for a seamless steel pipe according to an embodiment.
Figure 4:
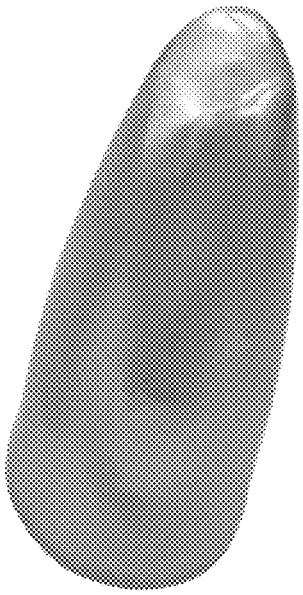
FIG. 4 is an appearance photograph of a plug according to an embodiment.

A ferrous plug was coated with a plating film of cobalt-0.1 mass % nickel (referred to as pure cobalt) in the case of the example A, cobalt-10 mass % nickel in the case of the example B and cobalt-30 mass % nickel in the case of the example C. As for example D, a plating film of cobalt-40 mass % nickel was also formed. Here, the average thickness of the plating film was about 2 mm in the case of the examples. Subsequently, by performing a heat treatment on these plugs in atmospheric air at 700° C. for a holding time of 20 hours, and by then performing natural air-cooling, oxide layers composed of cobalt-base oxide were formed on the surfaces of the plugs. FIG. 1 schematically illustrates the cross-sectional structure of the manufactured plugs including a plug body 1, a plating film 2, and an oxide layer 3. In addition, the appearance photograph of example B is shown in FIG. 4 as an example. In addition, FIG. 6 schematically illustrates the microstructure of the cross-section of the cobalt-base oxide layer.

The comparison between FIG. 3 and FIG. 4 indicates that, while the surface of the ferrous oxide layer which is a conventional example was rough and asperity like, the cobalt-base oxide layer of the disclosed example had a very flat and smooth surface. This indicates that the cobalt-base oxide had a very dense structure so as to be strongly compacted.

Figure 5:
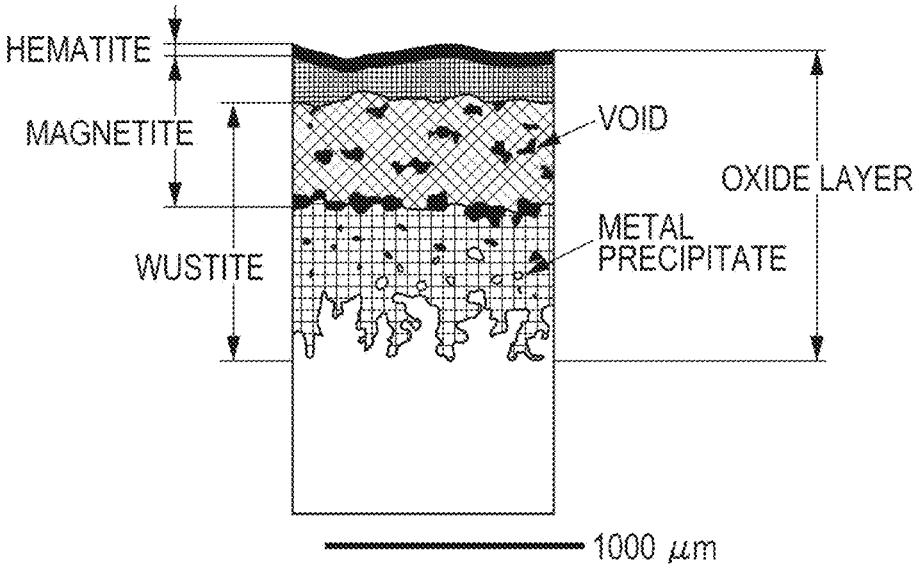
FIG. 5 (RELATED ART)
FIG. 5 is a pattern diagram of a microstructure of oxide layers according to a conventional technique.
Figure 6:
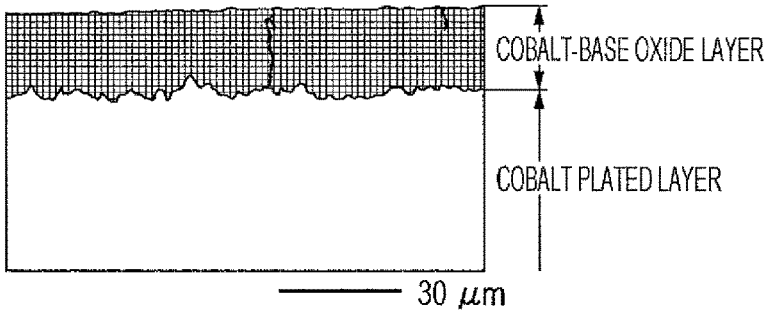
FIG. 6 is a pattern diagram of a microstructure of an oxide layer according to an embodiment.

In addition, as illustrated in FIG. 5 and FIG. 6, while the ferrous oxide layer had a very large thickness of nearly 1000 μm, the thickness of the cobalt-based oxide layer was controlled to be about 30 μm. Moreover, while the ferrous oxide layer was divided into wustite <FeO>, magnetite <$Fe_3O_4$> and hematite <$Fe_2O_3$> and had many voids therein, the cobalt-base oxide layer was composed of a single phase and had few voids so as to be strongly formed.

Incidentally, the average thickness of the cobalt-base oxide layer described above was 38 μm in the case of example A, 28 μm in the case of example B, 12 μm in the case of example C and only 2 μm in the case of example D. However, the examples of cobalt-base oxide layer have similar structure.

Here, the average thickness of the oxide layer was determined by performing image processing on cross-sectional photographs taken at five arbitrary positions of each of the plugs described above.

Subsequently, by using examples A, B and C as well as the conventional example and example D in a performance of rolling at a practical rolling line, the lives of the plugs were evaluated. The plug was cooled with water every time the plug was used for piercing one billet using a piercer and then used for piercing the next billet. The wear damage state of the plug surface was investigated after every performance of cooling, and the plug was replaced with another plug in the case where the plug was judged to have reached the end of its usefulness because of deformation due to an elevated temperature, wear or fracture.

Figure 7:
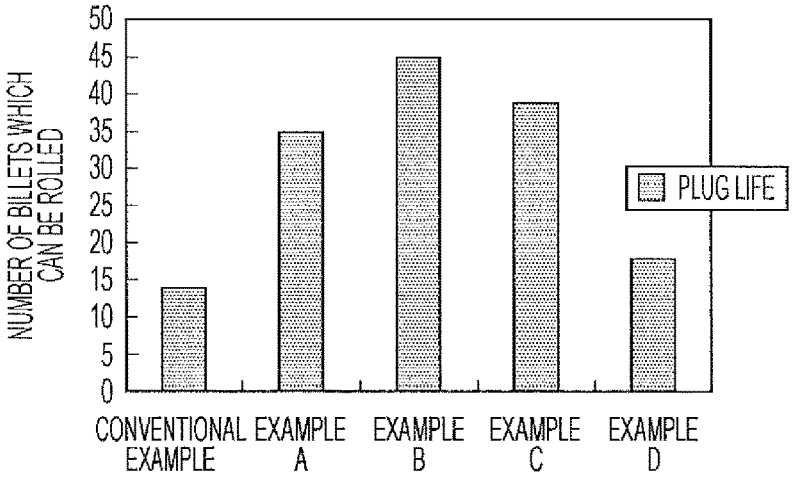
FIG. 7 is a diagram illustrating the experimental results indicating an effect of an embodiment.

FIG. 7 illustrates the average life (the number of billets rolled with one plug) of each kind of plug when plugs of that kind were used for rolling 1000 billets of high-alloy steel containing 13 mass % or more of Cr and compares the lives of the different kinds of plug. While the number of billets rolled with one plug without replacing the plug was about 14 in the case of the conventional plug, it was possible to roll 30 or more of billets with one plug in the case of examples A, B and C. In particular, example B was the best and had a long life so that it was possible to roll 45 billets on average. On the other hand, in the case of example D where a large amount of nickel was added, the life of the plug was better than that of the conventional example and was about 18.

Figure 8:
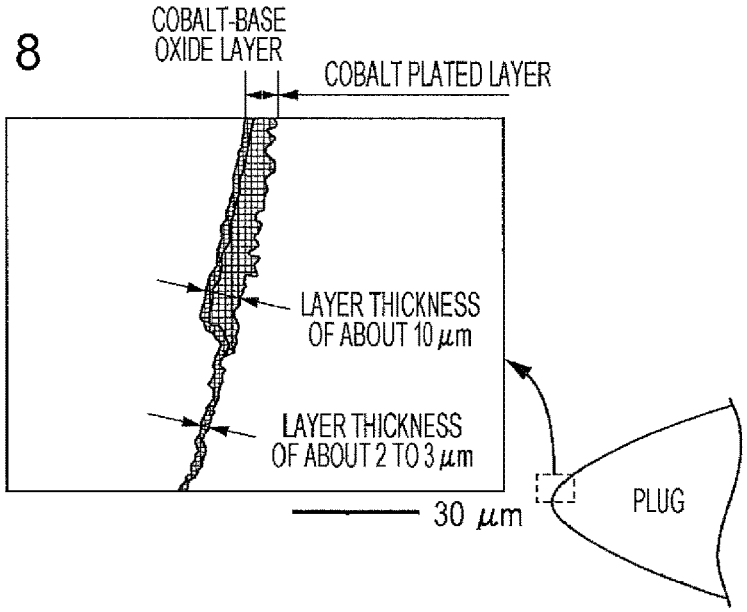
FIG. 8 is a pattern diagram illustrating a damaged condition of an oxide film of a plug tip which was collected in the middle of rolling processing.
Figure 9:
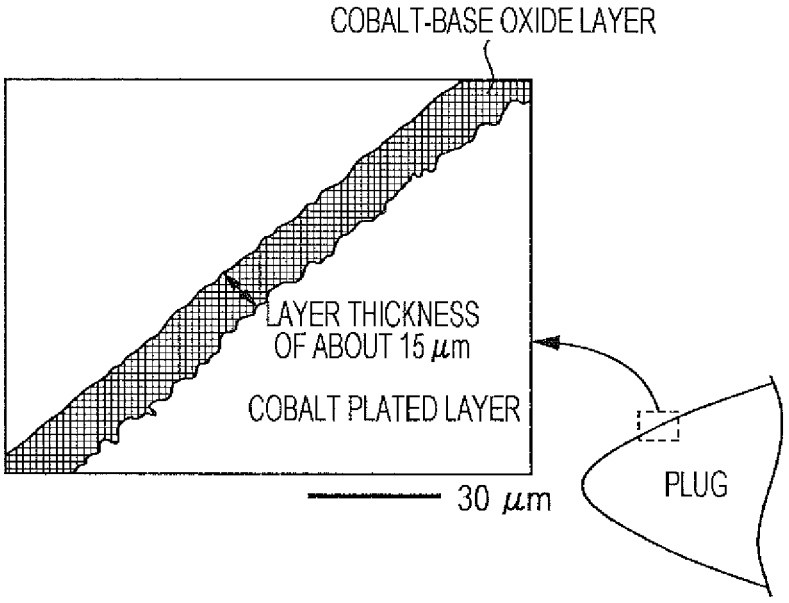
FIG. 9 is a pattern diagram illustrating the damaged condition of the oxide film at a position located 30 mm backward from the plug tip, which was collected in the middle of the rolling processing.

In the middle of the rolling experiments described above, by taking out one of the plugs for rolling in example A after having used for rolling 3 billets without damage, the state of the cobalt-base oxide layer was observed at the plug tip which was most likely to be damaged and at a position located 30 mm back from the plug tip. As FIG. 8 indicates, the thickness of the cobalt-base oxide layer at the plug tip was decreased to about 10 μm, and there was a portion from which the cobalt-base oxide layer seemed to have been removed. However, even in the portion from which the cobalt-base oxide layer seemed to have been removed, a cobalt-base oxide layer having a thickness of 2 to 3 μm was retained on the surface. In addition, as illustrated in FIG. 9, although the thickness of the cobalt-base oxide layer at a position located about 30 mm from the plug tip was decreased to about 15 μm, significant damage was not found in the cobalt-base oxide layer.

The observation results described above indicate the following phenomena. That is, an oxide layer composed of a cobalt-base oxide has sufficiently strong properties so as to be used for rolling a seamless steel pipe. However, in some cases, a plug tip which is subjected to a severe condition of the highest pressure and temperature is damaged after rolling has been performed only three times. However, since the plug has a high temperature when rolling is performed, a cobalt-base oxide is formed again in the damaged portion due to the oxidation characteristic of cobalt and therefore continues playing the role of a plug protector. It was confirmed that, since such a function is repeated, it is possible to use a plug for rolling 30 or more of billets.

On the other hand, in the case of example D, it is considered that, since the oxide generation speed was small due to an excessive amount of nickel being added in a plated layer as described above, it was impossible to sufficiently regenerate oxide layer that is damaged during rolling, which resulted in the plug reaching the end of its usefulness. Therefore, it is preferable that a plated layer have 30 mass % or less of nickel.

As described above, since any of examples A, B, C and D has an increased life in comparison to the conventional example, and since, in particular, examples A, B and C has a significantly increased life in comparison to the conventional example, it is possible to significantly increase the productivity of a high-alloy seamless steel pipe.

Although cobalt plating or cobalt-base alloy plating is described herein, a plated layer containing other chemical elements is not excluded by this disclosure.

In addition, a layer called an oxide layer composed of a cobalt-base oxide may contain also nickel in the oxide layer in the case where the plated layer contains nickel, and a case where other chemical elements are contained in the oxide layer is not out of the range according to embodiments. Here, examples of the other chemical elements include iron and copper.

The invention claimed is:

1. A plug for rolling of a seamless steel pipe, the plug comprising:

a base metal;

a coating layer formed on the base metal by coating a surface of the base metal with pure cobalt comprising 99 mass % or more of cobalt and a balance being inevitable impurities or a cobalt-nickel alloy, the cobalt-nickel alloy containing 0.3 mass % or more and 30 mass % or less of Ni; and an oxide layer including a cobalt-base oxide formed on a surface of the coating layer, wherein an average thickness of the oxide layer is in the range of 10 μm to 40 μm.

2. The plug for rolling of a seamless steel pipe according to claim 1, wherein the oxide layer is formed by performing a heat treatment by holding at a high temperature.

3. The plug for rolling of a seamless steel pipe according to claim 2, wherein the oxide layer is also formed using heat applied when rolling of the seamless steel pipe is performed.

4. The plug for rolling of a seamless steel pipe according to claim 1, wherein the oxide layer is formed using heat applied when rolling of the seamless steel pipe is performed.

5. The plug for rolling of a seamless steel pipe according to claim 1, wherein the base metal includes a ferrous material.

6. A method for manufacturing a seamless steel pipe, using the plug according to claim 1 comprising: piercing a billet with the plug; and rolling the billet to form the seamless steel pipe.

7. The plug for rolling of a seamless steel pipe according to claim 1, wherein the coating layer is formed by coating the surface with the cobalt-nickel alloy.

8. The plug for rolling of a seamless steel pipe according to claim 1, wherein the average thickness of the oxide layer is in the range of 28 μm to 40 μm.

9. A method for manufacturing a plug for rolling of a seamless steel pipe, the method comprising:

coating a surface of a metallic plug with a film including pure cobalt comprising 99 mass % or more of cobalt and a balance being inevitable impurities or a cobalt-nickel alloy having a thickness in the range of 0.1 mm to 2 mm, the cobalt-nickel alloy containing 0.3 mass % or more and 30 mass % or less of Ni; and after the coating step, performing a heat treatment in atmospheric air at a temperature of 300° C. to 1000° C. in order to form an oxide layer including a cobalt-base oxide, the oxide layer having an average thickness in the range of 10 μm to 40 μm.

10. The method for manufacturing a plug according to claim 9, wherein the heat treatment is performed using heat applied when rolling of the seamless steel pipe is performed.

11. The method for manufacturing a plug according to claim 9, wherein the coating of the metallic plug is performed by plating.

12. The method for manufacturing a plug according to claim 9, wherein the oxide layer has an average thickness in the range of 28 μm to 40 μm.

13. A plug for rolling of a seamless steel pipe, the plug comprising:

a base metal;

a coating layer formed on the base metal by coating a surface of the base metal with pure cobalt comprising 99 mass % or more of cobalt and a balance being inevitable impurities; and an oxide layer including a cobalt-base oxide formed on a surface of the coating layer, wherein an average thickness of the oxide layer is in the range of 10 μm to 40 μm.

14. The plug for rolling of a seamless steel pipe according to claim 13, wherein the average thickness of the oxide layer is in the range of 28 μm to 40 μm.

* * * * *